US006219513B1

(12) United States Patent
Ikeda

(10) Patent No.: US 6,219,513 B1
(45) Date of Patent: Apr. 17, 2001

(54) DEVELOPING DEVICE

(75) Inventor: Takashi Ikeda, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/502,020

(22) Filed: Feb. 11, 2000

(51) Int. Cl.[7] ..... G03G 15/08; G03G 15/09

(52) U.S. Cl. ..... 399/267; 399/53

(58) Field of Search ..... 399/53, 55, 56, 399/265, 266, 267, 270, 271, 272, 274, 276, 277; 430/45, 120, 122, 123

(56) References Cited

U.S. PATENT DOCUMENTS

| | | | | |
|---|---|---|---|---|
| 4,473,627 | * | 9/1984 | Kanbe et al. | 399/274 |
| 5,359,397 | * | 10/1994 | Yamaji | 399/274 |
| 5,621,505 | * | 4/1997 | Kobayashi et al. | 399/274 |
| 5,655,191 | * | 8/1997 | Furuya et al. | 399/231 |

FOREIGN PATENT DOCUMENTS 2881823 2/1999 (JP) .

* cited by examiner

*Primary Examiner*—Arthur T. Grimley
*Assistant Examiner*—Hoang Ngo

(74) *Attorney, Agent, or Firm*—Foley & Lardner

(57) ABSTRACT

A developing device of this invention that includes a developing sleeve extending substantially parallel to a substantially cylindrical image carrier and opposed for rotation to an outer peripheral surface of the image carrier with a given developing gap therefrom, a magnet roller located for reverse rotation in the developing sleeve with a given gap therefrom, and a developing bias applying member for applying a given developing bias between the image carrier and the developing sleeve. The magnet roller has a plurality of magnetic poles of different polarities that are arranged alternately along its outer peripheral surface.

Various parameters of the developing device are set so that A>280 is fulfilled where A is given by: $A=|Rs\times\omega m-Rd\times\omega d|\times P\times Vs\times T/Vp$, where Rs (mm) is the radius of the developing sleeve, ωm (rpm) is the rotational frequency of the magnet roller, Rd (mm) is the radius of the image carrier, ωd (rpm) is the rotational frequency of the image carrier, P is the number of magnetic poles of the magnet roller, Vs (mm/sec) is the peripheral speed of the outer peripheral surface of the developing sleeve, T is a magnetic flux density on the outer peripheral surface of the developing sleeve, and Vp (mm/sec) is the peripheral speed of the outer peripheral surface of the image carrier. By doing this, the tailing level is made satisfactory, and development can be effected with a relatively high resolution.

15 Claims, 2 Drawing Sheets

DEVELOPING DEVICE

BACKGROUND OF THE INVENTION

This invention relates to a developing device for supplying a developing agent to an electrostatic latent image formed on an image carrier and developing the image.

Conventionally, there is known a developing device of the two-component development type, in which a carrier and a toner that is mixed in a given ratio are agitated, charged, and supplied to an electrostatic latent image that is formed on the outer peripheral surface of a photoconductor drum for use as an image carrier, and the electrostatic latent image is developed with the charged toner.

The developing device of this type comprises a magnet roller having a plurality of magnetic poles arranged along its outer peripheral surface and a nonmagnetic cylindrical developing sleeve that is located around the magnet roller with a given gap. The magnet roller is fixedly provided in a predetermined position adjacent to the photoconductor drum so that its main pole faces the photoconductor drum. The developing sleeve is located for rotation in a position at a given distance from the outer peripheral surface of the photoconductor drum with a given developing gap between them.

A developing agent is held on the outer peripheral surface of the developing sleeve by means of a magnetic field that is generated by the magnet roller, whereupon a magnetic brush based on the developing agent is formed on the outer peripheral surface. The magnetic brush formed in this manner is trimmed to a given length by means of a doctor blade that is opposed to the outer peripheral surface of the developing sleeve, and is transported to the developing gap opposite the outer peripheral surface of the photoconductor drum as the developing sleeve rotates. The toner of the magnetic brush is supplied to the electrostatic latent image by means of a developing bias that is applied between the developing sleeve and the photoconductor drum, whereupon the electrostatic latent image is visualized.

In the conventional developing device of the two-component development type described above, however, a magnetic force (development inhibiting force) that settles a threshold value for development gradually changes in the developing gap where the developing sleeve faces the photoconductor drum, and the density of the magnetic brush that is formed on the developing sleeve according to the distribution of the magnetic poles of the magnet roller is subject to unevenness. Accordingly, the conventional developing device has a problem involving a phenomenon (hereinafter referred to as "tailing") such that the toner floating on the lower-stream side of the developing gap is attracted to the outer peripheral surface of the photoconductor drum in a magnetic trough (low-magnetism portion) between the main pole of the magnet roller and the magnetic pole that is situated directly on the lower-stream side of the main pole.

BRIEF SUMMARY OF THE INVENTION

This invention has been contrived in consideration of these circumstances, and its object is to provide a developing device capable of vibrating a developing agent with high frequency in a developing region opposite an image carrier and realizing development with a relatively high resolution without causing tailing.

In order to achieve the above object, a developing device of this invention serves to supply a developing agent, formed of a mixture of a toner and a carrier, to an electrostatic latent image, formed on an outer peripheral surface of an image carrier, and visualize the electrostatic latent image with the toner, and comprises a developing sleeve opposed to the outer peripheral surface of the image carrier and capable of rotating with the developing agent held on an outer peripheral surface thereof, thereby transporting the developing agent to the electrostatic latent image, a magnet roller located for rotation in the developing sleeve and having a plurality of magnetic poles for generating a given magnetic force on the outer peripheral surface of the developing sleeve, arranged in the rotating direction thereof, and developing bias applying means for applying a given developing bias between the image carrier and the developing sleeve to supply the toner in the developing agent held on the outer peripheral surface of the developing sleeve to the electrostatic latent image formed on the outer peripheral surface of the image carrier, wherein A>280 is fulfilled where A is given by:

$$A=|Rs\times\omega m-Rd\times\omega d|\times P\times Vs\times T/Vp,$$

where Rs (mm) is the radius of the developing sleeve, ωm (rpm) is the rotational frequency of the magnet roller, Rd (mm) is the radius of the image carrier, ωd (rpm) is the rotational frequency of the image carrier, P is the number of magnetic poles of the magnet roller, Vs (mm/sec) is the peripheral speed of the outer peripheral surface of the developing sleeve, T is a magnetic flux density on the outer peripheral surface of the developing sleeve, and Vp (mm/sec) is the peripheral speed of the outer peripheral surface of the image carrier.

Further, a developing device of this invention serves to supply a developing agent, prepared by mixing a magnetic toner and a magnetic carrier in a given ratio, to an electrostatic latent image, formed on an outer peripheral surface of a substantially cylindrical image carrier rotating in a given direction, and visualize the electrostatic latent image with the magnetic toner, and comprises a substantially cylindrical developing sleeve extending substantially parallel to the image carrier, having an outer peripheral surface opposed to the outer peripheral surface of the image carrier with a given developing gap therefrom and rotatable in the same direction as the outer peripheral surface of the image carrier in a region for the developing gap, and capable of transporting the developing agent held on the outer peripheral surface thereof to the developing gap, a magnet roller located coaxially in the developing sleeve with a given gap therefrom, having a plurality of magnetic poles of different polarities for generating a given magnetic force on the outer peripheral surface of the developing sleeve, arranged alternately in the rotating direction thereof, and rotatable reversely to the developing sleeve, and developing bias applying means for applying a given developing bias between the image carrier and the developing sleeve to supply the magnetic toner in the developing agent held on the outer peripheral surface of the developing sleeve to the electrostatic latent image formed on the outer peripheral surface of the image carrier in the region for the developing gap, wherein A>280 is fulfilled where A is given by:

$$A=|Rs\times\omega m-Rd\times\omega d|\times P\times Vs\times T/Vp,$$

where Rs (mm) is the radius of the developing sleeve, ωm (rpm) is the rotational frequency of the magnet roller, Rd (mm) is the radius of the image carrier, ωd (rpm) is the rotational frequency of the image carrier, P is the number of magnetic poles of the magnet roller, Vs (mm/sec) is the peripheral speed of the outer peripheral surface of the developing sleeve, T is a magnetic flux density on the outer peripheral surface of the developing sleeve, and Vp (mm/sec) is the peripheral speed of the outer peripheral surface of the image carrier.

According to the invention described above, moreover, the magnetic toner in the developing agent held on the outer peripheral surface of the developing sleeve, along with the magnetic carrier, is rolled on the outer peripheral surface of the developing sleeve to be charged by the agency of the magnetic force of the magnet roller rotating reversely to the developing sleeve, and is supplied to the electrostatic latent image by means of the developing bias given by the bias voltage applying means.

Further, a developing method of this invention is a developing method for holding a developing agent, formed of a mixture of a toner and a carrier, on an outer peripheral surface of a developing sleeve opposed to an outer peripheral surface of an image carrier rotating in a given direction, rotating the developing sleeve reversely to the image carrier, thereby supplying the developing agent held on the outer peripheral surface of said developing sleeve to an electrostatic latent image formed on the outer peripheral surface of the image carrier, and visualizing the electrostatic latent image with the toner in the developing agent, wherein the developing agent is held on the outer peripheral surface of the developing sleeve by the agency of a magnetic force generated on the outer peripheral surface of the developing sleeve by means of a magnet roller which is located in the developing sleeve for rotation in the same direction as the image carrier and which has a plurality of magnetic poles of different polarities arranged alternately in the rotating direction thereof, the developing agent, held on the outer peripheral surface of the developing sleeve, is transported to the outer peripheral surface of the image carrier as the developing sleeve rotates, and a given developing bias is applied between the developing sleeve and the image carrier to supply the toner of the developing agent held on the outer peripheral surface of the developing sleeve to the electrostatic latent image, thereby visualizing the electrostatic latent image; and A>280 is fulfilled where A is given by:

$$A=|Rs\times\omega m-Rd\times\omega d|\times P\times Vs\times T/Vp,$$

where Rs (mm) is the radius of the developing sleeve, ωm (rpm) is the rotational frequency of the magnet roller, Rd (mm) is the radius of the image carrier, ωd (rpm) is the rotational frequency of the image carrier, P is the number of magnetic poles of the magnet roller, Vs (mm/sec) is the peripheral speed of the outer peripheral surface of the developing sleeve, T is a magnetic flux density on the outer peripheral surface of the developing sleeve, and Vp (mm/sec) is the peripheral speed of the outer peripheral surface of the image carrier.

According to the invention described above, furthermore, the magnetic toner in the developing agent held on the outer peripheral surface of the developing sleeve by the agency of the magnetic force of the magnet roller is rolled on the outer peripheral surface of the developing sleeve to be charged while the magnetic toner is being transported toward the outer peripheral surface of the image carrier as the developing sleeve rotates.

DETAILED DESCRIPTION OF THE INVENTION

An embodiment of this invention will now be described in detail with reference to the drawings.

Figure 1:
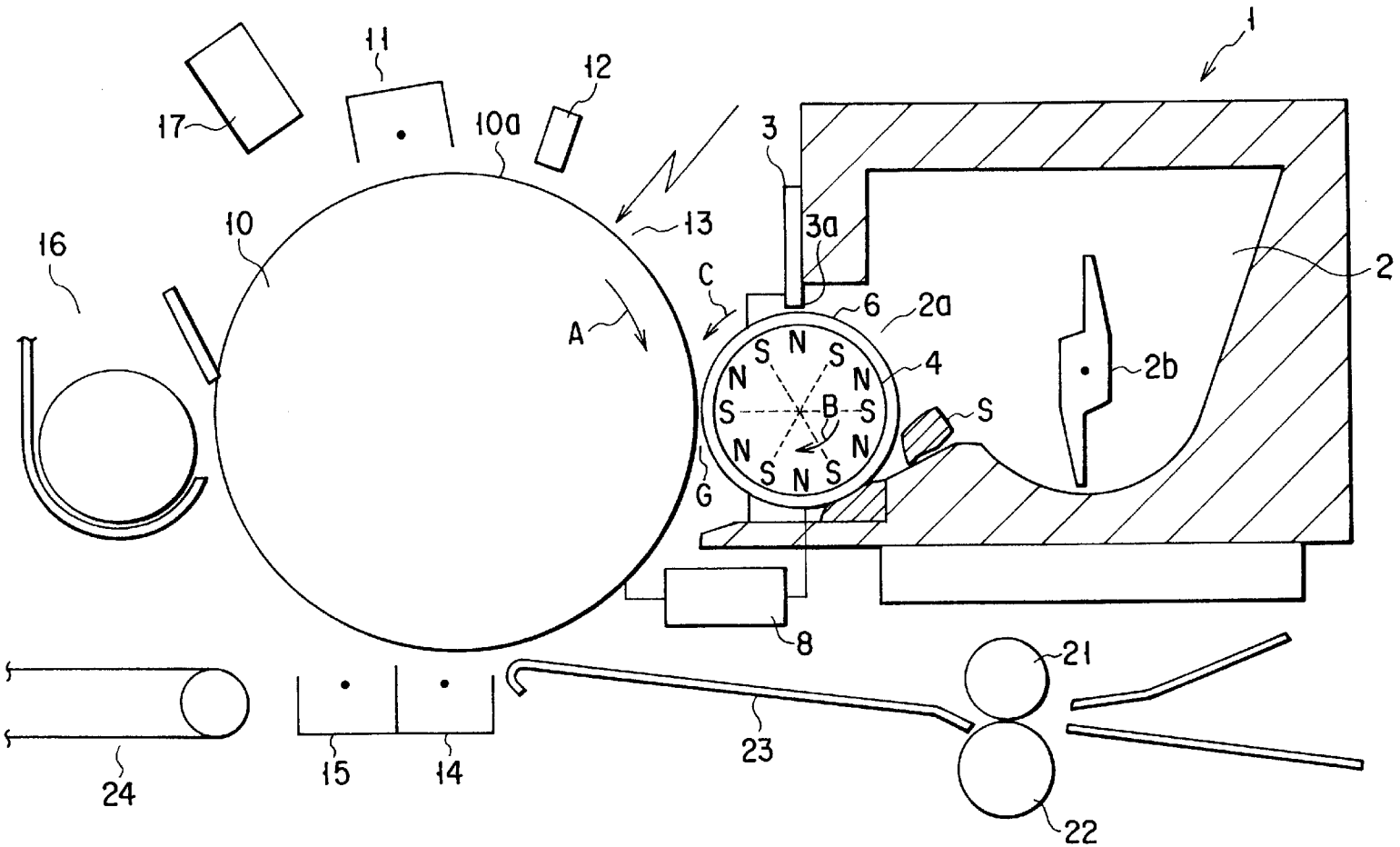
FIG. 1 is a schematic view showing an arrangement of the principal part of an image forming apparatus including a developing device according to an embodiment of this invention.

FIG. 1 schematically shows an arrangement of the principal part of an image forming apparatus including a developing device 1 according to the embodiment of this invention.

The image forming apparatus has a substantially cylindrical photoconductor drum 10 for use as an image carrier, which is rotatable in the direction of arrow A (clockwise direction) in the drawing. The photoconductor drum 10 is surrounded by a main charger 11 for charging the whole area of an outer peripheral surface 10*a* of the photoconductor drum 10 to a given potential, an erasing array 12 for erasing electric charges in any other regions than an image forming region on the outer peripheral surface 10*a*, a developing device 1 adapted to be passed through an exposure position 13 to supply a charged magnetic toner to an electrostatic latent image formed on the outer peripheral surface 10*a*, thereby visualizing the image, a transfer charger 14 for transferring the visualized toner image to the surface of a sheet, a separation charger 15 for separating the sheet, having the transferred toner image thereon, from the outer peripheral surface 10*a*, a cleaning device 16 for removing the magnetic toner remaining on the outer peripheral surface 10*a* without being transferred to the sheet, and a discharge lamp 17 for removing electric charges remaining on the outer peripheral surface 10*a*, which are successively arranged in a rotating direction A of the photoconductor drum 10.

The developing device 1 is underlain by a pair of aligning rollers 21 and 22 for temporarily aligning the leading end of each sheet from a sheet cassette (not shown) with respect to the delivery direction and feeding the sheet into a transfer region between the outer peripheral surface 10*a* of the photoconductor drum 10 and the transfer charger 14. A guide member 23 for supporting and guiding the underside of the sheet is provided in a sheet transportation path that extends from the aligning rollers 21 and 22 to the transfer region. On the lower-stream side of the separation charger 15 with respect to the sheet transportation direction, moreover, a conveyor belt 24, which is passed through the transfer region and serves to transport the sheet separated from the outer peripheral surface 10*a* of the photoconductor drum 10 to a fixing device (not shown), extends for endless travel.

In delivering an output image onto the sheet by means of the image forming apparatus constructed in the aforesaid manner, a laser beam based on image data is emitted through an exposure device (not shown), the outer peripheral surface 10*a* of the photoconductor drum 10, charged to the given potential by means of the main charger 11, is exposed to the laser beam for scanning in the given exposure position 13 on the outer peripheral surface 10*a*, whereupon an electrostatic latent image based on the image data is formed on the outer peripheral surface 10*a*.

As the photoconductor drum 10 rotates, the electrostatic latent image thus formed on the outer peripheral surface 10*a* is passed through a region (region for a developing gap G) in which the developing device 1 is opposed to it, whereupon it is visualized with the magnetic toner that is supplied by means of the developing device 1. The toner image visualized on the outer peripheral surface 10*a* of the photoconductor drum 10 is transported to the transfer region as the photoconductor drum 10 rotates.

On the other hand, the sheet is taken out of the sheet cassette (not shown), temporarily aligned by means of the pair of aligning rollers 21 and 22, and fed into the transfer region in time with the transportation of the toner image visualized on the outer peripheral surface 10*a* of the photoconductor drum 10.

Then, a given bias is applied to the sheet by means of the transfer charger 14, whereupon the toner image formed on the outer peripheral surface 10*a* of the photoconductor drum 10 is transferred to the surface of the sheet that is passed through the transfer region. The sheet, having the transferred toner image thereon, is separated from the outer peripheral surface 10*a* of the photoconductor drum 10 by means of the separation charger 15, and transported to a fixing device (not shown) by means of the conveyor belt 24.

When the sheet having the transferred toner image thereon is fed into the fixing device, the transferred toner image on the sheet is fused and pressed against the surface of the sheet, whereupon it is fixed on the sheet as an image based on the image data. The sheet having the image thus formed thereon is discharged onto a receiving tray (not shown).

The developing device 1 according to the present invention uses a developing agent that is prepared by mixing a magnetic toner containing 40 to 60% of magnetic powder and a magnetic carrier in a given ratio.

The developing device 1 includes a storage section 2 stored with the developing agent, a magnet roller 4 and a developing sleeve 6 located for rotation in an opening 2*a* of the storage section 2 that opens to the photoconductor drum 10, and developing bias applying means 8 for applying a developing bias between the photoconductor drum 10 and the developing sleeve 6.

The storage section 2 contains therein a rotatable agitator 2*b* for feeding the developing agent from the storage section 2 into a magnetic attraction region S that is situated close to the developing sleeve 6. A replenishment port (not shown) for the resupply of a fresh developing agent is formed in the upper part of the storage section 2.

The magnet roller 4 is formed substantially in the shape of a cylinder having a plurality of magnetic poles along the outer peripheral surface and extends substantially parallel to the photoconductor drum 10 for rotation in the direction of arrow B (clockwise direction) in the drawing. The magnet roller 4 has an even number of magnetic poles (12 poles according to the present embodiment), including south and north poles of different polarities arranged alternately along the outer peripheral surface. All the magnetic poles of the magnet roller 4 have the same magnetic force.

The developing sleeve 6, which is formed of a substantially cylindrical nonmagnetic material, is located coaxially with the magnet roller 4 for rotation around the magnet roller 4 with a given gap from the outer peripheral surface of the magnet roller 4. Further, the developing sleeve 6 is opposed to the outer peripheral surface 10*a* of the photoconductor drum 10 with the given developing gap G therefrom, and rotates in the same direction as the outer peripheral surface 10*a* of the photoconductor drum 10 in the region for the developing gap G. More specifically, the developing sleeve 6 rotates counterclockwise in the direction of arrow C in the drawing, that is, reversely to the magnet roller 4. In the present embodiment, the distance between the developing sleeve 6 and the outer peripheral surface 10*a* of the photoconductor drum 10, that is, the developing gap G, is adjusted to 0.35 mm.

A doctor blade 3 of a nonmagnetic material is opposed to the outer peripheral surface of the developing sleeve 6 on the upper-stream side of the developing gap G. The doctor blade 3, which is fixed to an enclosure of the developing device 1, for example, has a distal end 3*a* that faces the outer peripheral surface of the developing sleeve 6 across a given gap. In the present embodiment, the distal end 3*a* of the doctor blade 3 is situated at a distance of 0.30 mm from the outer peripheral surface of the developing sleeve 6.

The developing device 1 constructed in this manner operates in the following manner.

As the agitator 2*b* rotates in the clockwise direction of the drawing, the developing agent stored in the storage section 2 of the developing device 1 is fed into the magnetic attraction region S that is situated close to the developing sleeve 6. The developing agent in the magnetic attraction region S is attracted to and held on the outer peripheral surface of the developing sleeve 6 by the agency of the magnetic force of the magnetic poles of the magnet roller 4 rotates in the direction of arrow B that acts on the outer peripheral surface of the developing sleeve 6, and is transported toward the developing gap G by means of the developing sleeve 6 that rotates in the direction of arrow C.

The developing agent transported from the magnetic attraction region S toward the developing gap G is agitated in a manner such that it rolls on the outer peripheral surface of the developing sleeve 6 in the course of the transportation, and the magnetic toner in the developing agent is injected with given electric charges and charged.

In this case, the concentration of the magnetic toner in the developing agent rolling on the outer peripheral surface of the developing sleeve 6 changes above and below about 50%, so that the magnetic toner content, compared to the magnetic carrier, is higher than in the case of the conventional two-component development system. According to the conventional two-component development system, trouble such as carrier pickup or lowering of concentration occurs unless the concentration changes within about ±1 wt % of the existing specific toner concentration. According to the development system of the present embodiment, on the other hand, defective images cannot be formed if the concentration varies within about ±20 wt % of the existing specific toner concentration.

According to the present embodiment, as described above, a so-called 1.5-component development system is employed such that a small quantity of magnetic carrier is held on the outer peripheral surface of the developing sleeve 6 and rolled together with the magnetic toner, and the magnetic toner is injected with electric charges to be charged and transported to the developing gap G. With use of this system, there is no necessity for precise adjustment of the specific toner concentration that is required by the conventional two-component development system.

The developing agent containing the magnetic toner charged on the outer peripheral surface of the developing sleeve 6 is passed through the distal end 3*a* of the doctor blade 3 and the outer peripheral surface of the developing sleeve 6 so that its delivery is regulated. Thus, the developing agent to be fed into the developing gap G is adjusted to a given volume.

In the developing gap G, a developing bias from the developing bias applying means is applied between the outer peripheral surface 10*a* of the photoconductor drum 10 and the developing sleeve 6 to form a predetermined developing electric field between them, the charged magnetic toner in the developing agent transported to the developing gap G is attracted to the electrostatic latent image formed on the outer peripheral surface 10*a* of the photoconductor drum 10, and the electrostatic latent image is visualized with the magnetic toner.

Figure 2:
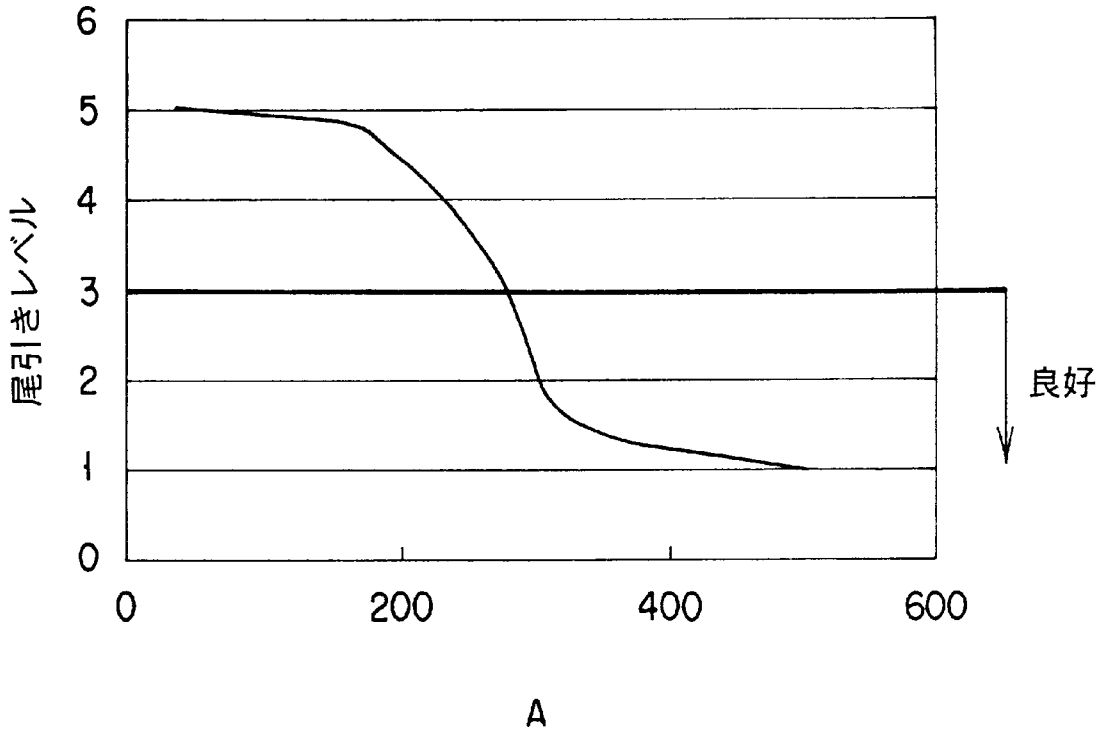
FIG. 2 is a graph showing change of the tailing level observed when various parameters of the developing device of FIG. 1 are changed.

FIG. 2 is a graph showing the result of examination of the change of the level of tailing on the outer peripheral surface 10*a* of the photoconductor drum 10 observed when various parameters of the developing device 1 are changed.

The various parameters of the developing device 1 include a radius Rs (mm) of the developing sleeve 6, rotational frequency ωm (rpm) of the magnet roller 4, radius Rd (mm) of the photoconductor drum 10, rotational frequency ωd (rpm) of the photoconductor drum 10, number P of magnetic poles of the magnet roller 4, peripheral speed Vs (mm/sec) of the outer peripheral surface of the developing sleeve 6, magnetic flux density T (T) on the outer peripheral surface of the developing sleeve 6, and peripheral speed Vp (mm/sec) of the outer peripheral surface 10*a* of the photoconductor drum 10. With these parameters varied, tailing levels were examined for A given by $$A=|Rs\times\omega m-Rd\times\omega d|\times P\times Vs\times T/Vp.$$

In consequence, satisfactory tailing levels of 3 or less were obtained when the various parameters were set so that A>280 was fulfilled. Thus, it was indicated that the tailing levels are within tolerance limits.

Some examples of the set parameters of the developing device 1 that provide satisfactory tailing levels will now be described in comparison with a comparative example.

EXAMPLE 1

In Example 1, the radius of the developing sleeve 6 was adjusted to Rs=10 (mm); rotational frequency of the magnet roller 4 to ωm=2,117 (rpm), number of magnetic poles of the magnet roller 4 to 12, radius of the photoconductor drum 10 to Rd=15 (mm), peripheral speed of the developing sleeve 6 to Vs=254 (mm/sec), peripheral speed of the photoconductor drum 10 to Vp=127 (mm/sec), and magnetic flux density on the outer peripheral surface of the developing sleeve 6 to T=0.0007 (T). In this case, the tailing level was 2, a satisfactory value. Other image qualities proved to be satisfactory without involving defects in images attributable to ground smudging.

EXAMPLE 2

In Example 2, the radius of the developing sleeve 6 was adjusted to Rs=10 (mm); rotational frequency of the magnet roller 4 to ωm=1,587 (rpm), number of magnetic poles of the magnet roller 4 to 12, radius of the photoconductor drum 10 to Rd=15 (mm), peripheral speed of the developing sleeve 6 to Vs=254 (mm/sec), peripheral speed of the photoconductor drum 10 to Vp=127 (mm/sec), and magnetic flux density on the outer peripheral surface of the developing sleeve 6 to T=0.0007 (T). In this case, the tailing level was 4, an unsatisfactory value. When the magnetic flux density on the outer peripheral surface of the developing sleeve 6 was readjusted to T=0.0008 (T), however, A>280 was able to be fulfilled, and the tailing level turned to 3, a satisfactory value.

EXAMPLE 3

In Example 3, the radius of the developing sleeve 6 was adjusted to Rs=10 (mm); rotational frequency of the magnet roller 4 to ωm=1,587 (rpm), number of magnetic poles of the magnet roller 4 to 12, radius of the photoconductor drum 10 to Rd=15 (mm), peripheral speed of the developing sleeve 6 to Vs=254 (mm/sec), peripheral speed of the photoconductor drum 10 to Vp=127 (mm/sec), and magnetic flux density on the outer peripheral surface of the developing sleeve 6 to T=0.0007 (T). In this case, the tailing level was 4, an unsatisfactory value. When the peripheral speed of the developing sleeve 6 was readjusted to Vs=381 (mm/sec), however, A>280 was able to be fulfilled, and the tailing level turned to 1.5, a satisfactory value.

Comparative Example

In a comparative example, the radius of the developing sleeve 6 was adjusted to Rs=10 (mm); rotational frequency of the magnet roller 4 to ωm=1,300 (rpm), number of magnetic poles of the magnet roller 4 to 12, radius of the photoconductor drum 10 to Rd=15 (mm), peripheral speed of the developing sleeve 6 to Vs=167 (mm/sec), peripheral speed of the photoconductor drum 10 to Vp=84 (mm/sec), and magnetic flux density on the outer peripheral surface of the developing sleeve 6 to T=0.0007 (T). In this case, A=158 was obtained, and the tailing level was 4.5, an unsatisfactory value.

According to the developing device of the present invention, the various parameters of the developing device were set so as to meet the aforesaid condition [A>280]. By doing this, the movement of the magnetic toner from the developing sleeve 6 to the photoconductor drum 10 and the movement of the magnetic toner from the photoconductor drum 10 to the developing sleeve 6 were able to be repeated with high frequency, the tailing level became satisfactory, and defective images that involve tailing was able to be eliminated. By doing this, moreover, development can be effected with a relatively high resolution.

This invention is not limited to the embodiment described above, and that various changes may be effected therein without departing from the scope the invention.

What is claimed is:

1. A developing device for supplying a developing agent, formed of a mixture of a toner and a carrier, to an electrostatic latent image, formed on an outer peripheral surface of an image carrier, and visualizing said electrostatic latent image with said toner, the developing device comprising:

a developing sleeve opposed to the outer peripheral surface of said image carrier and capable of rotating with said developing agent held on an outer peripheral surface thereof, thereby transporting said developing agent to said electrostatic latent image;

a magnet roller located for rotation in the developing sleeve and having a plurality of magnetic poles for generating a given magnetic force on the outer peripheral surface of said developing sleeve, arranged in the rotating direction thereof; and developing bias applying means for applying a given developing bias between said image carrier and the developing sleeve to supply the toner in the developing agent held on the outer peripheral surface of said developing sleeve to the electrostatic latent image formed on the outer peripheral surface of said image carrier, wherein A>280 is fulfilled where A is given by:

$$A=|Rs\times\omega m-Rd\times\omega d|\times P\times Vs\times T/Vp,$$

where Rs (mm) is the radius of said developing sleeve, ωm (rpm) is the rotational frequency of said magnet roller, Rd (mm) is the radius of said image carrier, ωd (rpm) is the rotational frequency of said image carrier, P is the number of magnetic poles of said magnet roller, Vs (mm/sec) is the peripheral speed of the outer peripheral surface of said developing sleeve, T is a magnetic flux density on the outer peripheral surface of said developing sleeve, and Vp (mm/sec) is the peripheral speed of the outer peripheral surface of said image carrier.

2. A developing device according to claim 1, wherein said toner in said developing agent is a magnetic toner containing 40 to 60% of magnetic powder.

3. A developing device according to claim 1, wherein the number of magnetic poles of said magnet roller is an even number.

4. A developing device according to claim 3, wherein all said magnetic poles have the same magnetic force.

5. A developing device according to claim 1, wherein said image carrier and said developing sleeve rotate in opposite directions, and said image carrier and said magnet roller rotate in the same direction.

6. A developing device for supplying a developing agent, prepared by mixing a magnetic toner and a magnetic carrier in a given ratio, to an electrostatic latent image, formed on an outer peripheral surface of a substantially cylindrical image carrier rotating in a given direction, and visualizing said electrostatic latent image with said magnetic toner, the developing device comprising:

a substantially cylindrical developing sleeve extending substantially parallel to said image carrier, having an outer peripheral surface opposed to the outer peripheral surface of said image carrier with a given developing gap therefrom and rotatable in the same direction as the outer peripheral surface of said image carrier in a region for said developing gap, and capable of transporting said developing agent held on the outer peripheral surface thereof to said developing gap;

a magnet roller located coaxially in the developing sleeve with a given gap therefrom, having a plurality of magnetic poles of different polarities for generating a given magnetic force on the outer peripheral surface of said developing sleeve, arranged alternately in the rotating direction thereof, and rotatable reversely to said developing sleeve; and developing bias applying means for applying a given developing bias between said image carrier and the developing sleeve to supply the magnetic toner in the developing agent held on the outer peripheral surface of said developing sleeve to the electrostatic latent image formed on the outer peripheral surface of said image carrier in the region for said developing gap, wherein A>280 is fulfilled where A is given by:

$$A=|Rs\times\omega m-Rd\times\omega d|\times P\times Vs\times T/Vp,$$

where Rs (mm) is the radius of said developing sleeve, ωm (rpm) is the rotational frequency of said magnet roller, Rd (mm) is the radius of said image carrier, ωd (rpm) is the rotational frequency of said image carrier, P is the number of magnetic poles of said magnet roller, Vs (mm/sec) is the peripheral speed of the outer peripheral surface of said developing sleeve, T is a magnetic flux density on the outer peripheral surface of said developing sleeve, and Vp (mm/sec) is the peripheral speed of the outer peripheral surface of said image carrier.

7. A developing device according to claim 6, wherein said magnetic toner in the developing agent held on the outer peripheral surface of said developing sleeve, along with said magnetic carrier, is rolled on the outer peripheral surface of said developing sleeve to be charged by the agency of the magnetic force of the magnet roller rotating reversely to said developing sleeve, and is supplied to said electrostatic latent image by means of the developing bias given by said bias voltage applying means.

8. A developing device according to claim 7, wherein said magnetic toner in said developing agent contains 40 to 60% of magnetic powder.

9. A developing device according to claim 7, wherein the number of magnetic poles of said magnet roller is an even number.

10. A developing device according to claim 9, wherein all said magnetic poles have the same magnetic force.

11. A developing method for holding a developing agent, formed of a mixture of a toner and a carrier, on an outer peripheral surface of a developing sleeve opposed to an outer peripheral surface of an image carrier rotating in a given direction, rotating said developing sleeve reversely to said image carrier, thereby supplying the developing agent held on the outer peripheral surface of said developing sleeve to an electrostatic latent image formed on the outer peripheral surface of said image carrier, and visualizing said electrostatic latent image with the toner in said developing agent:

wherein said developing agent is held on the outer peripheral surface of said developing sleeve by the agency of a magnetic force generated on the outer peripheral surface of said developing sleeve by means of a magnet roller which is located in said developing sleeve for rotation in the same direction as said image carrier and which has a plurality of magnetic poles of different polarities arranged alternately in the rotating direction thereof;

the developing agent, held on the outer peripheral surface of said developing sleeve, is transported to the outer peripheral surface of said image carrier as said developing sleeve rotates; and a given developing bias is applied between said developing sleeve and said image carrier to supply the toner of the developing agent held on the outer peripheral surface of said developing sleeve to said elect rostatic latent image, thereby visualizing said electrostatic latent image; and A>280 is fulfilled where A is given by:

$$A=|Rs\times\omega m-Rd\times\omega d|\times P\times Vs\times T/Vp,$$

where Rs (mm) is the radius of said developing sleeve, ωm (rpm) is the rotational frequency of said magnet roller, Rd (mm) is the radius of said image carrier, ωd (rpm) is the rotational frequency of said image carrier, P is the number of magnetic poles of said magnet roller, Vs (mm/sec) is the peripheral speed of the outer peripheral surface of said developing sleeve, T is a magnetic flux density on the outer peripheral surface of said developing sleeve, and Vp (mm/sec) is the peripheral speed of the outer peripheral surface of said image carrier.

12. A developing method according to claim 11, wherein said toner in said developing agent is a magnetic toner containing 40 to 60% of magnetic powder.

13. A developing method according to claim 12, wherein said magnetic toner in the developing agent held on the outer peripheral surface of said developing sleeve by the agency of the magnetic force of said magnet roller is rolled on the outer peripheral surface of said developing sleeve to be charged while the magnetic toner is being transported toward the outer peripheral surface of said image carrier as said developing sleeve rotates.

14. A developing method according to claim 11, wherein the number of magnetic poles of said magnet roller is an even number.

15. A developing method according to claim 14, wherein all said magnetic poles have the same magnetic force.

* * * * *